US010263367B2

(12) United States Patent
Nicolas et al.

(10) Patent No.: US 10,263,367 B2
(45) Date of Patent: Apr. 16, 2019

(54) ELECTRICAL CONNECTOR WITH ROTARY CONNECTOR POSITION ASSURANCE DEVICE

(71) Applicant: Tyco Electronics France SAS, Pontoise (FR)

(72) Inventors: Simon Nicolas, La Garenne-Colombes (FR); Pamart Olivier, Ecouen (FR); Rouillard Xavier, Franconville (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 15/474,402

(22) Filed: Mar. 30, 2017

(65) Prior Publication Data

US 2017/0288342 A1 Oct. 5, 2017

(30) Foreign Application Priority Data

Mar. 30, 2016 (FR) ..... 16 52761

(51) Int. Cl.

*H01R 13/627* (2006.01)
*H01R 13/629* (2006.01)
*H01R 13/639* (2006.01)
*H01R 13/641* (2006.01)

(52) U.S. Cl.

CPC ..... *H01R 13/641* (2013.01); *H01R 13/6271* (2013.01); *H01R 13/62955* (2013.01); *H01R 13/639* (2013.01); *H01R 13/6397* (2013.01)

(58) Field of Classification Search

CPC ..... H01R 13/6295; H01R 13/62955; H01R 13/639; H01R 13/641; H01R 13/6271

See application file for complete search history.

(56) References Cited

U.S. PATENT DOCUMENTS 1,793,015 A * 2/1931 Roos ..... F16L 37/20 285/311
3,830,525 A * 8/1974 Ransford, III ... H01R 13/62933 285/2
4,682,847 A * 7/1987 Moore ..... H01R 13/62933 439/271
5,120,255 A 6/1992 Kouda et al.

(Continued)

FOREIGN PATENT DOCUMENTS

EP 2876745 A1 5/2015
FR 3008833 A1 7/2013

(Continued)

OTHER PUBLICATIONS

French Search Report, dated Nov. 8, 2016, 8 pages.
EP Search Report dated May 26, 2017, 8 pages.

*Primary Examiner* — Edwin A. Leon
*Assistant Examiner* — Oscar C Jimenez
(74) *Attorney, Agent, or Firm* — Barley Snyder

(57) ABSTRACT

An electrical connector comprises a housing and a connector position assurance device. The housing has a locking lever locking the housing to a mating housing of a mating electrical connector. The connector position assurance device is fitted on the locking lever and is pivotable in relation to the housing from a delivery position to a locking position. The connector position assurance device, when in the locking position, prevents unlocking of the locking lever when the housing is connected to the mating housing.

20 Claims, 15 Drawing Sheets

(56) References Cited

U.S. PATENT DOCUMENTS

| | | | | |
|---|---|---|---|---|
| 5,201,670 | A * | 4/1993 | Watanabe | H01R 13/62933 439/372 |
| 6,319,050 | B1 * | 11/2001 | Miyazaki | H01R 13/62938 439/157 |
| 7,238,050 | B2 * | 7/2007 | Sakakura | H01R 9/032 439/157 |
| 7,419,390 | B2 * | 9/2008 | Ohtaka | H01R 13/62955 439/157 |
| 7,563,114 | B2 * | 7/2009 | Patterson | H01R 13/62955 439/157 |
| 8,251,714 | B2 * | 8/2012 | Yeh | H05K 7/1069 439/330 |
| 8,784,127 | B2 * | 7/2014 | Bashkin | H01R 13/62944 439/372 |
| 9,028,163 | B2 * | 5/2015 | Advey | B60L 11/1818 403/322.4 |
| 2004/0192090 | A1 * | 9/2004 | Flowers | H01R 13/5812 439/157 |
| 2006/0040535 | A1 * | 2/2006 | Koshy | H01R 13/62977 439/157 |
| 2010/0291787 | A1 * | 11/2010 | Kuo | H01R 13/633 439/352 |
| 2014/0377970 | A1 * | 12/2014 | Crovetti | H01R 13/5213 439/131 |
| 2017/0237201 | A1 * | 8/2017 | Neureiter | H01R 13/639 |

FOREIGN PATENT DOCUMENTS

| | | | |
|---|---|---|---|
| FR | 3010841 | A1 | 3/2015 |
| WO | 2012007343 | A1 | 1/2012 |
| WO | 2012096948 | A2 | 7/2012 |

* cited by examiner

ELECTRICAL CONNECTOR WITH ROTARY CONNECTOR POSITION ASSURANCE DEVICE

CROSS-REFERENCE TO RELATED APPLICATION

This application claims the benefit of the filing date under 35 U.S.C. § 119(a)-(d) of French Patent Application No. 1652761, filed on Mar. 30, 2016.

FIELD OF THE INVENTION

The present invention relates to an electrical connector, and more particularly, to an electrical connector having a connector position assurance device.

BACKGROUND

Electrical connectors having a connector position assurance device ("CPA device") are known in the art. The CPA device is used to ensure that a connection between two mating connectors is maintained in environments subject to shocks or vibrations which, without a CPA device, might result in disconnection of the system. In the automotive industry for example, CPA devices are used to meet strict locking requirements of vehicle electrical connectors.

Known electrical connectors generally have a connector housing suitable for receiving at least one electrical contact and a locking device suitable for locking the housing to the housing of a mating electrical connector. Such a direct locking action between the connector housing and the mating connector is conventionally referred to as "primary locking" or "main locking". The CPA device is commonly inserted from outside into the connector housing, and can be moved linearly in relation to the housing in an insertion direction of the mating connectors from a delivery position into a locking position. In the locking position, the CPA device blocks the locking device of the connector housing and/or a locking device of the mating connector when the electrical connector is connected to a mating connector. Such a connector is known, for example, from FR 3008833 A1, U.S. Pat. No. 5,120,255 A or WO 2012/096948 A2. Known alternatives specify prior assembly of the CPA device inside the connector housing. In this instance, the CPA device is then moved, for example, automatically by a spring, from the delivery position into the locking position. Such a connector is known, for example, from EP 2876745 A1 or FR 3010841 A1. The additional locking between the connector housing and the mating connector by the CPA device is conventionally referred to as "secondary locking".

Requirements of CPA devices vary greatly across applications, and consequently, electrical connectors with CPA devices are commonly manufactured specifically for individual applications. Furthermore, known electrical connectors with CPA devices are large and are complicated to install.

SUMMARY

An object of the invention, among others, is to provide an electrical connector having a connector position assurance device which is more compact and is usable across a range of applications. An electrical connector according to the invention comprises a housing and a connector position assurance device. The housing has a locking lever locking the housing to a mating housing of a mating electrical connector. The connector position assurance device is fitted on the locking lever and is pivotable in relation to the housing from a delivery position to a locking position. The connector position assurance device, when in the locking position, prevents unlocking of the locking lever when the housing is connected to the mating housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
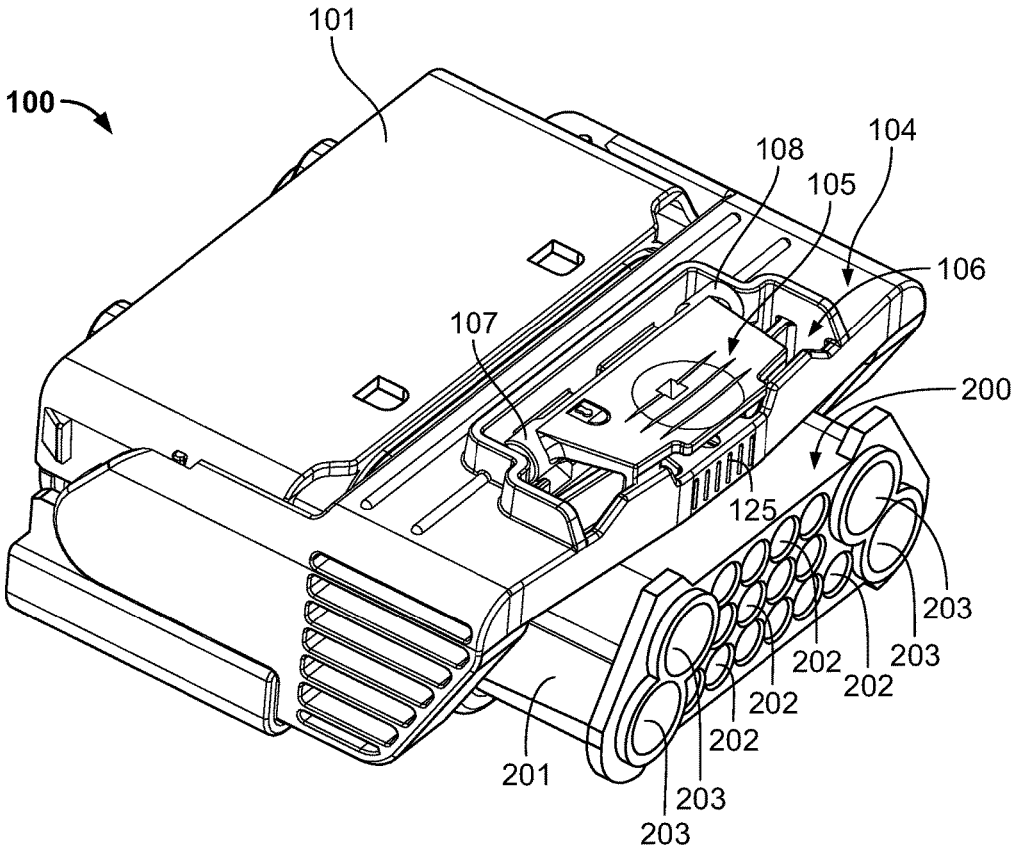
FIG. 1 is a perspective view of an electrical connector according to the invention locked to a mating connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

An electrical connector 100 and a mating connector 200 according to the invention are shown in FIGS. 1-4.

Figure 2A:
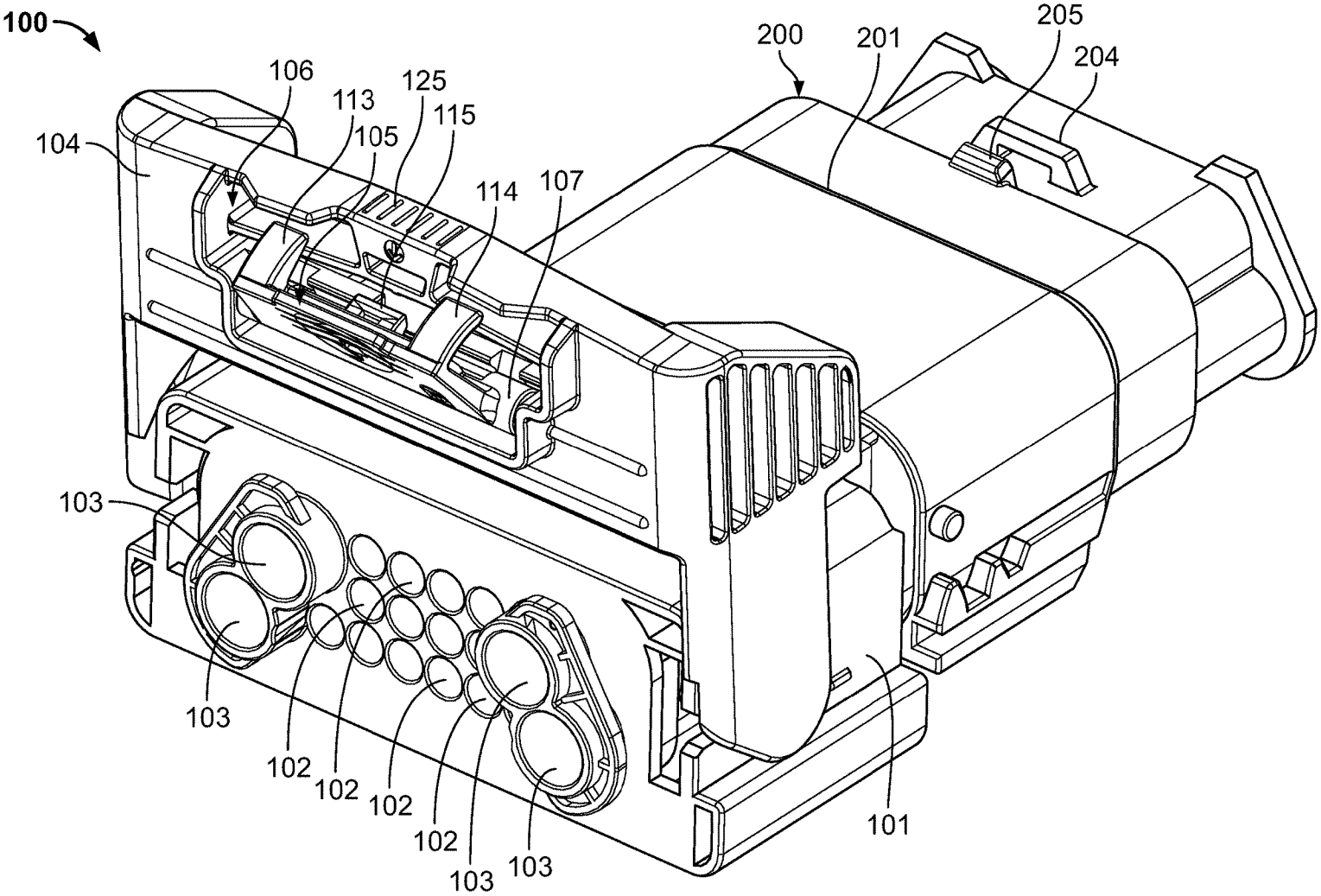
FIG. 2A is a perspective view of the connector of FIG. 1 with a connector position assurance device of the electrical connector in a delivery position and in a first position with respect to the mating connector.
Figure 2B:
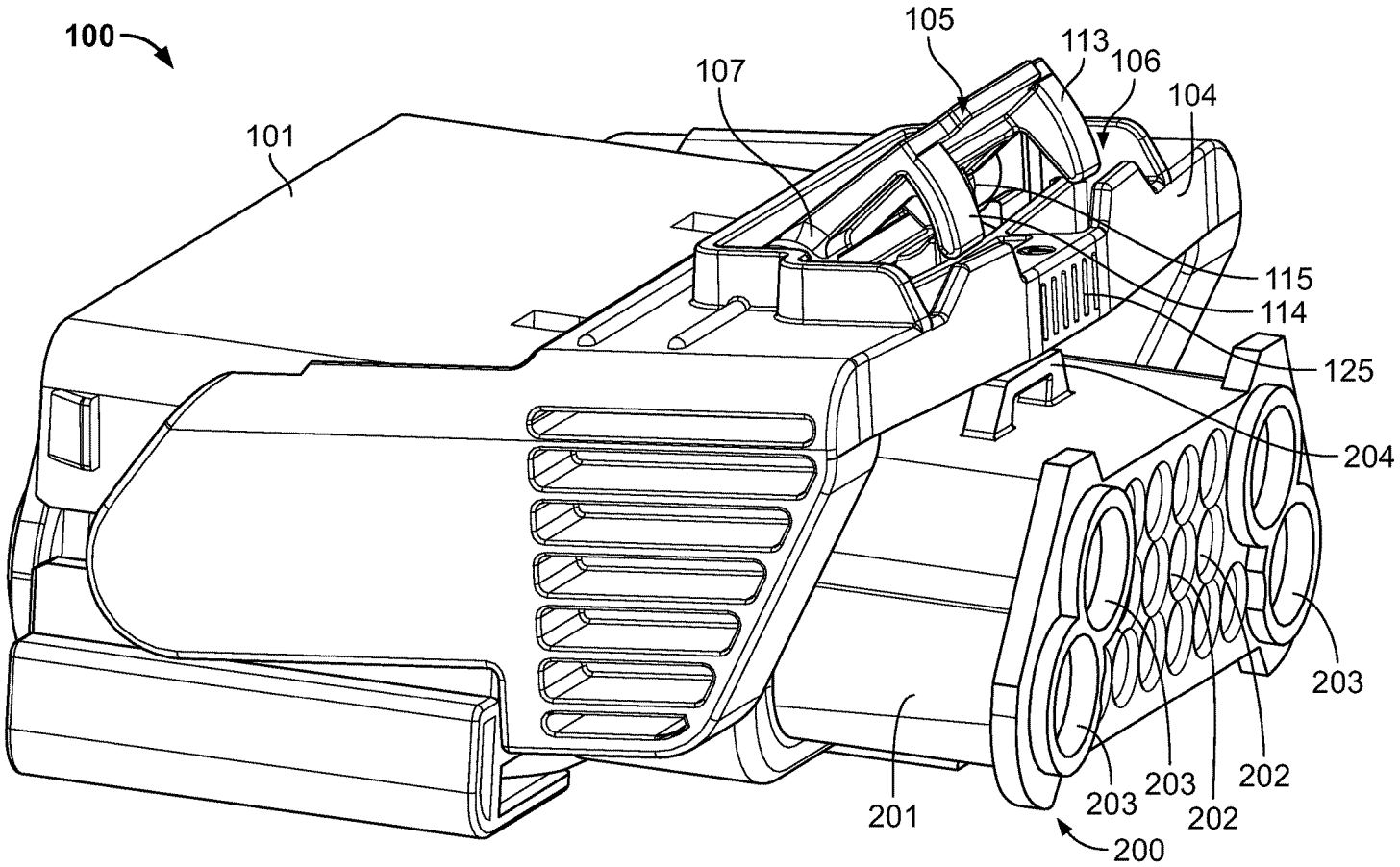
FIG. 2B is a perspective view of the connector of FIG. 1 with a connector position assurance device of the electrical connector in a delivery position and in a second position with respect to the mating connector.

The connector 100, as shown in FIGS. 1, 2A, and 2B, has a housing 101 receiving one or more electrical terminals disposed on the end of electrical cables and comprising electrical contacts which can be inserted in respective slots 102, 103 of the housing 101. A mating housing 201 of the mating connector 200 has mating slots 202, 203 receiving the same number of electrical cables provided with terminals and mating electrical contacts as those of the connector 100. Depending on the applications, the size of some slots 102, 103 provided in the housing 101 and/or some slots 202, 203 provided in the mating housing 201 may be different from that of other slots. In the shown embodiment, for example, the slots 103 and the mating slots 203 receive cables of greater diameter than the slots 102 and 202; other configurations of the slots 102, 103 and 202, 203 are also possible.

The connector 100, as shown in FIGS. 1, 2A, and 2B, has a locking lever 104 disposed on the housing 101. The locking lever 104 is shown in an open, unlocked position in FIG. 2A, in a partially folded position in FIG. 2B, and in a completely folded and locked position in FIG. 1.

The locking lever 104 of the connector 100 locks with a mating locking member 204 of the mating connector 200. The locking lever 104 locks the housing 101 to the mating housing 201 when the latter is correctly inserted in the housing 101, for example by hooking on the locking member 204. The connector 100 and the mating connector 200 are shown prior to full connection in FIGS. 2A and 2B and connected and locked in FIG. 1. The locking member 204, as shown in FIGS. 2A and 2B, protrudes from the mating housing 201 of the mating connector 200 in a ring, bridge, or inverted horseshoe shape.

The connector 100, as shown in FIGS. 1, 2A, and 2B, also has a connector position assurance ("CPA") device 105. The CPA device 105 is fitted on the locking lever 104 in a pivotable manner in relation to the lever 104 and therefore also in relation to the housing 101. The CPA device 105 is joined to the locking lever 104 so as to form a pivot connection or hinge in a receiving space 106 of the locking lever 104. Once fitted in the receiving space 106, the CPA device 105 can pivot at least between a raised position shown in FIGS. 2A and 2B, also referred to herein as a delivery position, and a folded position in the receiving space 106 shown in FIG. 1.

The CPA device 105 has a pivoting portion 107, 108 which is provided at an end thereof, as shown in FIGS. 1, 2A, 2B, and 4E. The pivoting portion 107, 108 has a respective recess 109, 110 enabling fitting on an element forming a pivot axis 111, 112 in the receiving space 106 of the lever 104, forming the hinge which allows the CPA device 105 to pivot. In other embodiments, however, the hinge could be formed by more or fewer pivot points.

The CPA device 105, as shown in FIGS. 1, 2A, and 2B, has first projections 113, 114 for maintaining a locking between the locking lever 104 and the locking member 204. The first projections 113, 114 are disposed on an end of the CPA device 105 distal from the pivoting portion 107, 108. In the shown embodiment, the first projections 113, 114 are hooks protruding substantially in a folding direction toward the folded position of the CPA device 105. The CPA device 105 also has a second projection 115 shown in FIGS. 2A and 2B protruding in the same direction as the first projections 113, 114. The second projection 115 engages a lug 116 of the lever 104 as shown in FIG. 4D.

Figure 3A:
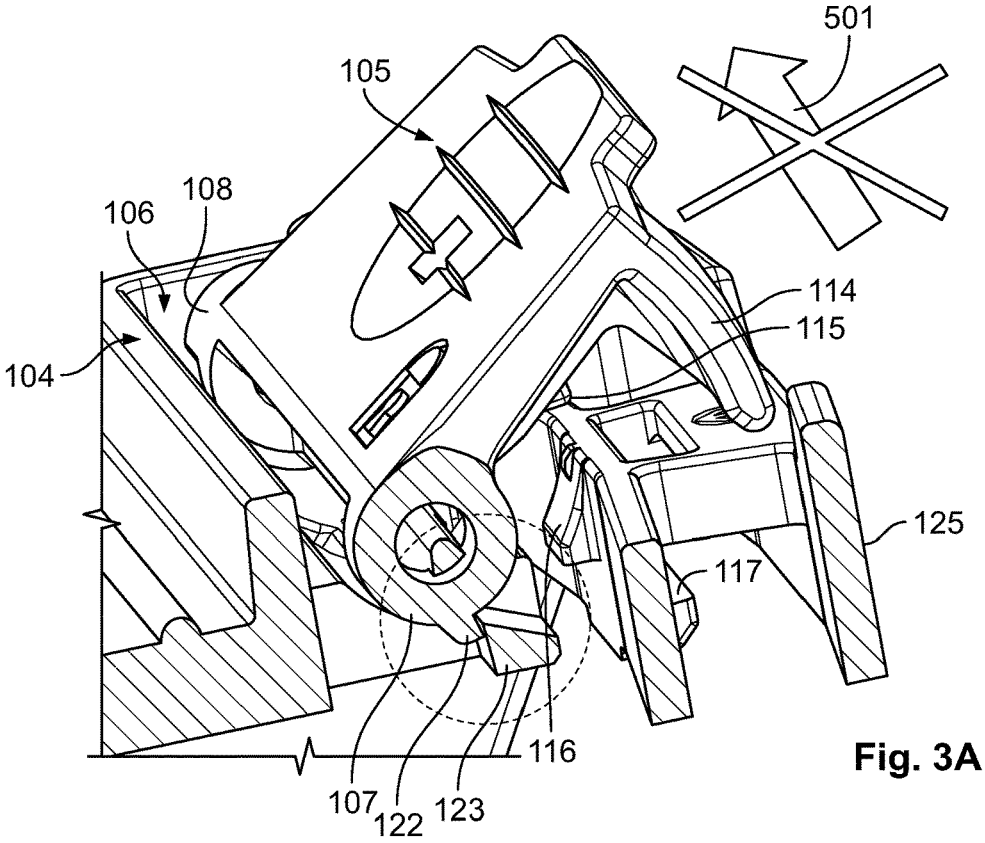
FIG. 3A is a sectional view of the connector position assurance device of FIG. 2A.
Figure 3B:
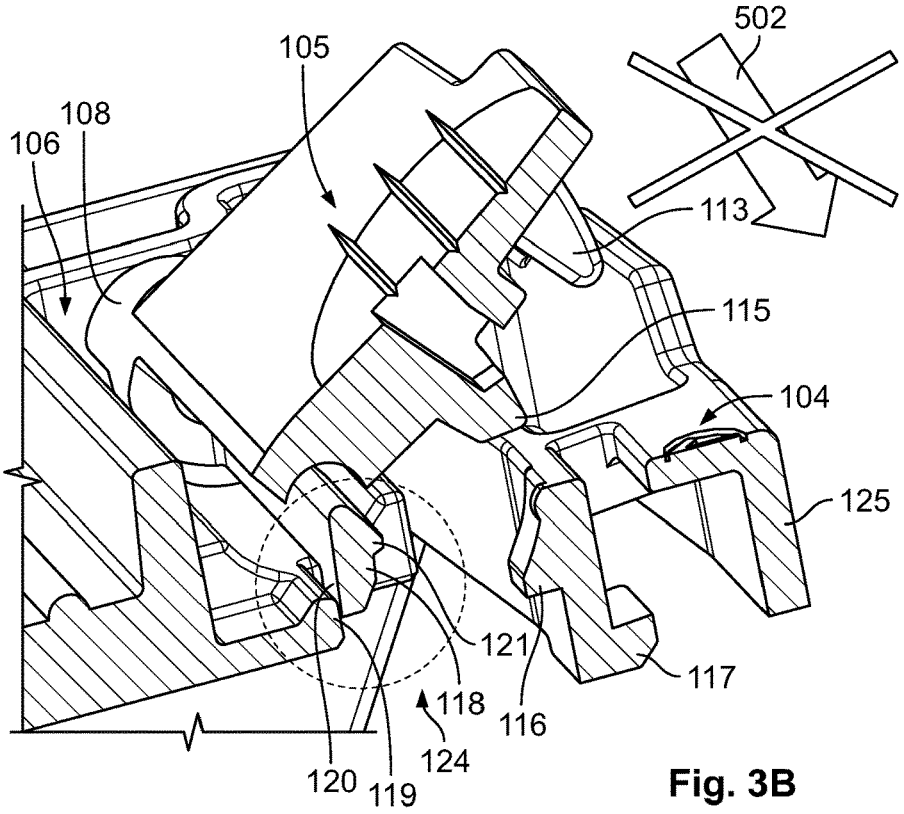
FIG. 3B is a sectional view of the connector position assurance device of FIG. 2A.

The raised position of the CPA device 105, shown in FIGS. 2A and 2B, will now be described in greater detail with reference to FIGS. 3A and 3B. In FIGS. 3A and 3B, the CPA device 105 is in the raised position and the connector 100 is not connected or locked to the mating connector 200.

The pivoting portion 107, 108 prevents inadvertent pivoting or folding down of the CPA device 105 in an activation or locking direction indicated by the arrow 502 in FIG. 3B. A first blocking member 118 connecting the two parts of the pivoting portion 107, 108 of the CPA device 105, shown in the dashed circle in FIG. 3B, forms a blocking lug 121 on one side and a planar stop 120 on an opposite side. The planar stop 120, in the raised position of the CPA device 105, abuts a first stop 119 of the locking lever 104 as shown in FIG. 3B to prevent pivoting of the CPA device 105 in the direction of the folded position.

The pivoting portion 107, 108 also prevents inadvertent withdrawal or detachment of the CPA device 105 fitted on the locking lever 104 in an unlocking direction 501 shown in FIG. 3A. The unlocking direction 501 is counter to the locking direction 502 shown in FIG. 3B. A second blocking member 122 protruding from the pivoting portion 107, 108, as shown in FIG. 3A, abuts a second stop 123 of the locking lever 104, preventing pivoting of the CPA device 105 in the unlocking direction 501. Although only the second blocking member 122 protruding from the pivoting portion 107, 108 and the second stop 123 are shown in FIG. 3A, one skilled in the art will appreciate that an equivalent projection and configuration may also be provided alternatively or additionally elsewhere along the pivoting portion 107, 108 so as to reinforce this blocking action.

As shown in FIGS. 3A and 3B, the pivoting portion 107, 108 of the CPA device 105 is blocked and held in the raised position as long as a connection and main locking have not been carried out between the mating connectors 100, 200.

The locking between the connector 100 and the mating connector 200 will now be described in greater detail with reference to FIGS. 4A-4E. In FIGS. 4A-4E, the mating housing 201 of the mating connector 200 is correctly inserted in the housing 101 of the connector 100.

After an approach between the mating connectors 100, 200, shown in FIG. 2A, the mating housing 201 is inserted in the housing 101 as far as the end position thereof, as shown in FIG. 2B, wherein electrical contact is established between the conductive elements of the two connectors 100, 200. The locking lever 104 can then begin to be folded down in the locking direction, which may be the same direction as the activation/locking direction of the CPA device 105, and which can therefore also be indicated by the arrow 502.

Figure 4A:
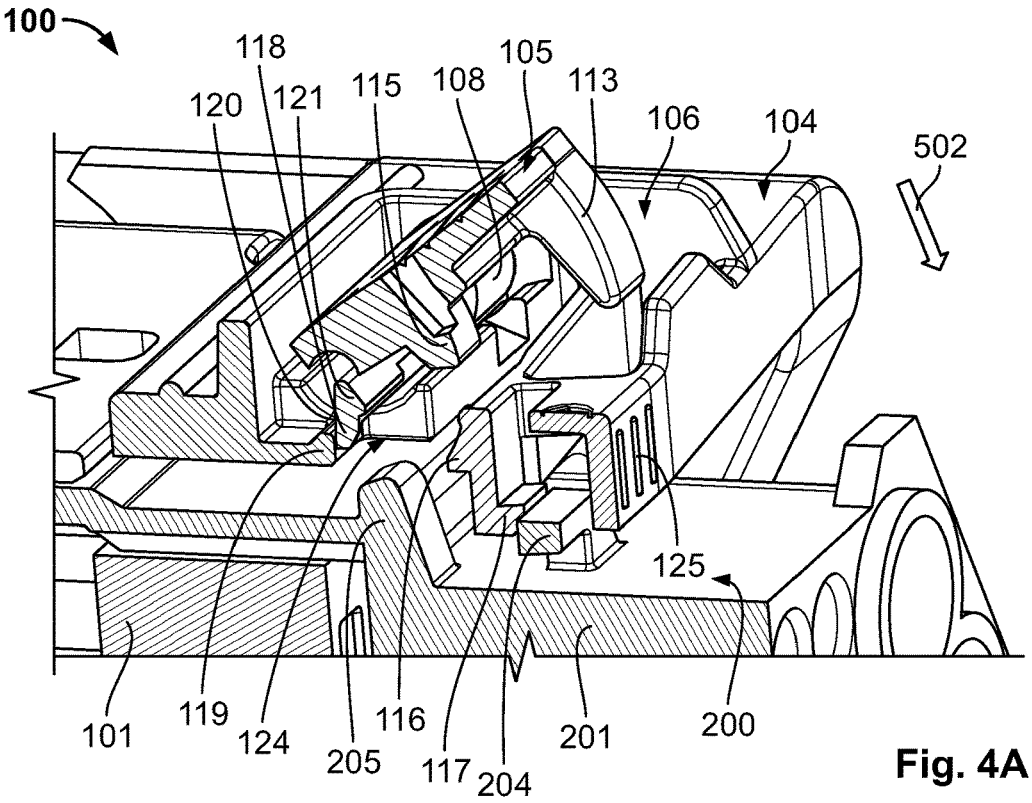
FIG. 4A is a sectional view of a first connection step between the connector of FIG. 1 and the mating connector.

The step shown in FIG. 4A follows the full insertion of the mating housing 201 into the housing 101 shown in FIG. 2B. The locking lever 104 is folded down in the direction 502 so that a physical contact is initiated between the locking lever 104 and the mating housing 201, in particular between a locking leg 117 of the lever 104 and the locking member 204 of the housing 201. The locking leg 117 has not yet hooked onto the locking member 204 and the CPA device 105 is still blocked in the raised position as shown in FIGS. 3A and 3B.

Figure 4B:
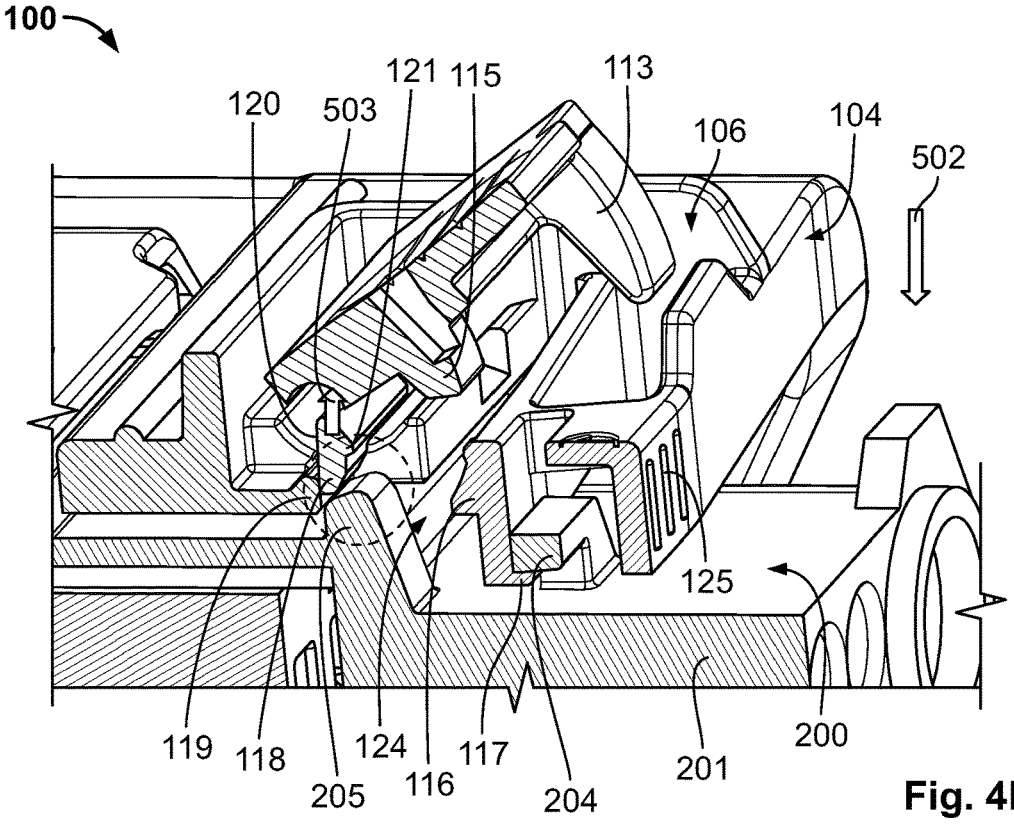
FIG. 4B is a sectional view of a second connection step between the connector of FIG. 1 and the mating connector.

The rotation of the locking lever 104 is continued, as shown in FIG. 4B. The locking leg 117 begins to hook on the locking member 204. The locking lever 104, as shown in the dashed circle in FIG. 4B, is now sufficiently lowered for the CPA device 105, still in its raised position, to come into contact with a release projection 205 protruding from the mating housing 201. The release projection 205 is disposed further forward than the locking member 204 in the direction of the connector 100. An opening 124 disposed on the locking lever 104 enables the release projection 205 to shift and abut the blocking member 118. The continuation of the rotation of the locking lever 104 in the locking direction 502 enables the release projection 205 to exert pressure on the blocking member 118 in a disengagement direction 503. The CPA device 105 will be able to begin to be released from its raised position.

Figure 4C:
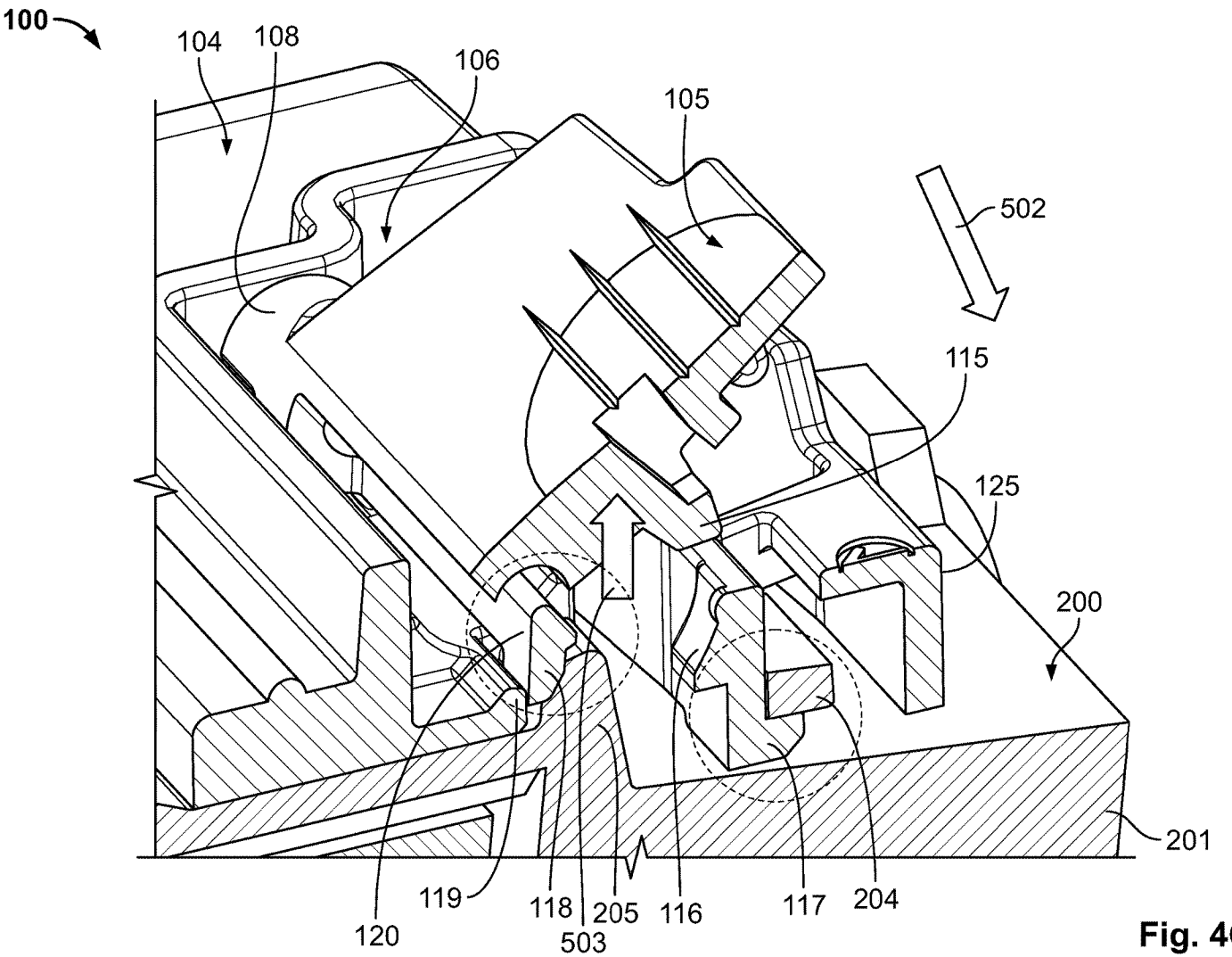
FIG. 4C is a sectional view of a third connection step between the connector of FIG. 1 and the mating connector.
Figure 4D:
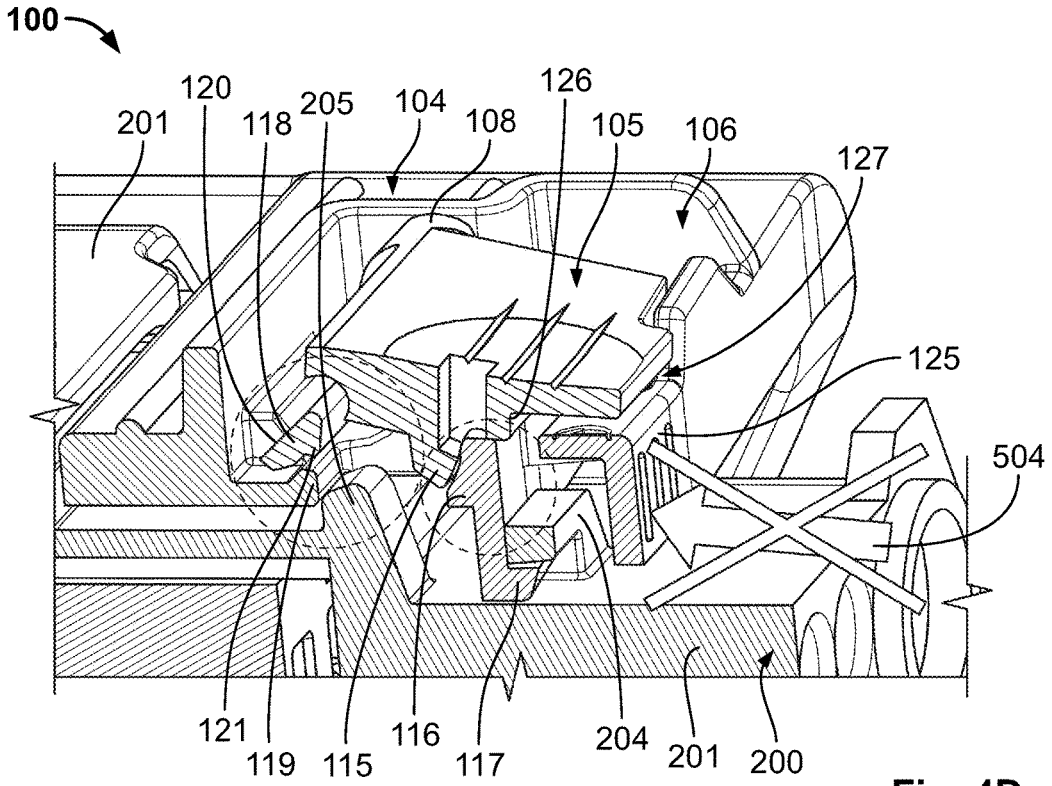
FIG. 4D is a sectional view of a fourth connection step between the connector of FIG. 1 and the mating connector.

Locking of the locking lever 104 to the locking member 204 is complete in FIG. 4C; the locking leg 117 of the locking lever 104 hooks onto the locking member 204. The locking lever 104 of the connector 100 and the locking member 204 of the mating connector 200 carry out main locking. The release projection 205, as shown in FIG. 4C, exerts pressure against the blocking member 118 in the disengagement direction 503 sufficient to release the CPA device 105. The blocking member 118 is disengaged from above the first stop 119 of the lever 104 so that the CPA device 105 is able to be pivoted in its activation/locking direction 502. The release of the blocking member 118 of the CPA device 105 from its stop against the first stop 119 of the lever 104 also brings about the release of the second blocking member 122 of the CPA device 105 from its stop against the second stop 123 of the lever 104.

The CPA device 105 is activated so as to carry out secondary locking. However, in the step shown in FIG. 4C, the lever 104 can still be unlocked by exerting pressure on an unlocking surface 125 in an unlocking direction 504, which would bring about the backward movement of the locking leg 117 in relation to the locking member 204, thereby enabling the locking lever 104 to be lifted, if necessary.

Figure 4E:
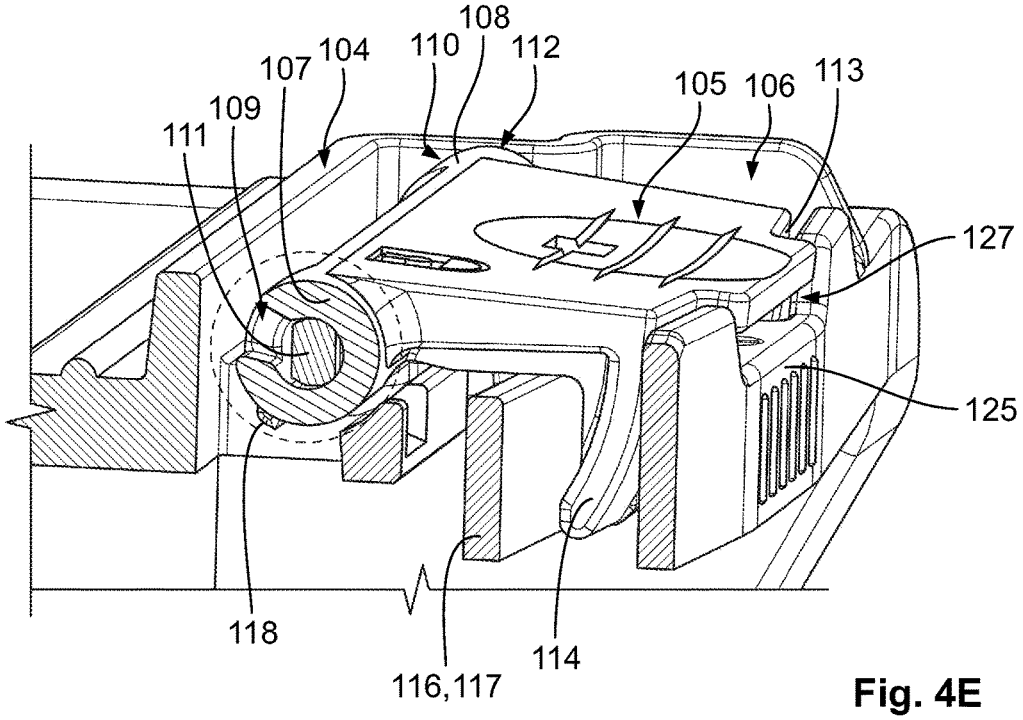
FIG. 4E is a sectional view of the fourth connection step between the connector of FIG. 1 and the mating connector.

With respect to the step shown in FIG. 4C, in FIGS. 4D and 4E, the rotation of the CPA device 105 from its raised position to its locking position has been completed; the CPA device 105 has been completely folded down in the space 106 as far as its locking position. The mating connectors 100, 200 are locked together by main or primary locking, which is itself carried out by the secondary locking brought about by the CPA device 105. The first projections 113, 114 of the CPA device 105 hook onto the locking lever 104, as shown in FIG. 4E.

The recesses 109, 110 of the pivoting portion 107, 108 and the pivot axis 111, 112 prevent detachment of the CPA device 105 from the locking position. Furthermore, in the locking position of the CPA device 105, the second projection 115 abuts the lug 116 of the locking lever 104, which therefore prevents disengagement of the locking leg 117 stopped against the lug 116, as shown in FIG. 4D. The rotation of the CPA device 105 into the locking position positions the blocking member 118 on the other side of the first stop 119 of the lever 104 so that now its side forming the blocking lug 121 is stopped against the first stop 119, as shown in FIG. 4D.

The two stops formed by the second projection 115 and the lug 116 on the one hand, and by the blocking lug 121 and the first stop 119 on the other hand, prevent unlocking of the CPA device 105 and therefore also unlocking of the locking lever 104. From the locking position, it is no longer possible to unlock the lever 104 simply by pressing on the unlocking surface 125 in the direction indicated by the arrow 504; backward movement of the locking leg 117 is now prevented by the second projection 115. The main locking is then carried out in the direction 504.

In order to unlock the system, an operator could push the CPA device 105 manually in the unlocking direction 504 so as to disengage the second projection 115 from its stop against the lug 116 and thereby enable the CPA device 105 to be lifted in order to return the system to a state corresponding to the one shown in FIG. 4C. Alternatively or additionally, a gap or a space 127 is disposed between the unlocking surface 125 and the CPA device 105, as shown in FIGS. 4D and 4E, so as to be able to insert a tool exerting pressure on a surface 126 of the CPA device 105 in the unlocking direction 504, enabling disengagement of the projection 115 from its stop against the lug 116. When the CPA device 105 is moved back to the raised position, it is again possible to release the lever 104 and to thereby unlock the connectors 100, 200.

A connector 300 and a mating connector 400 according to another embodiment of the invention are shown in FIGS. 5-8.

Figure 5:
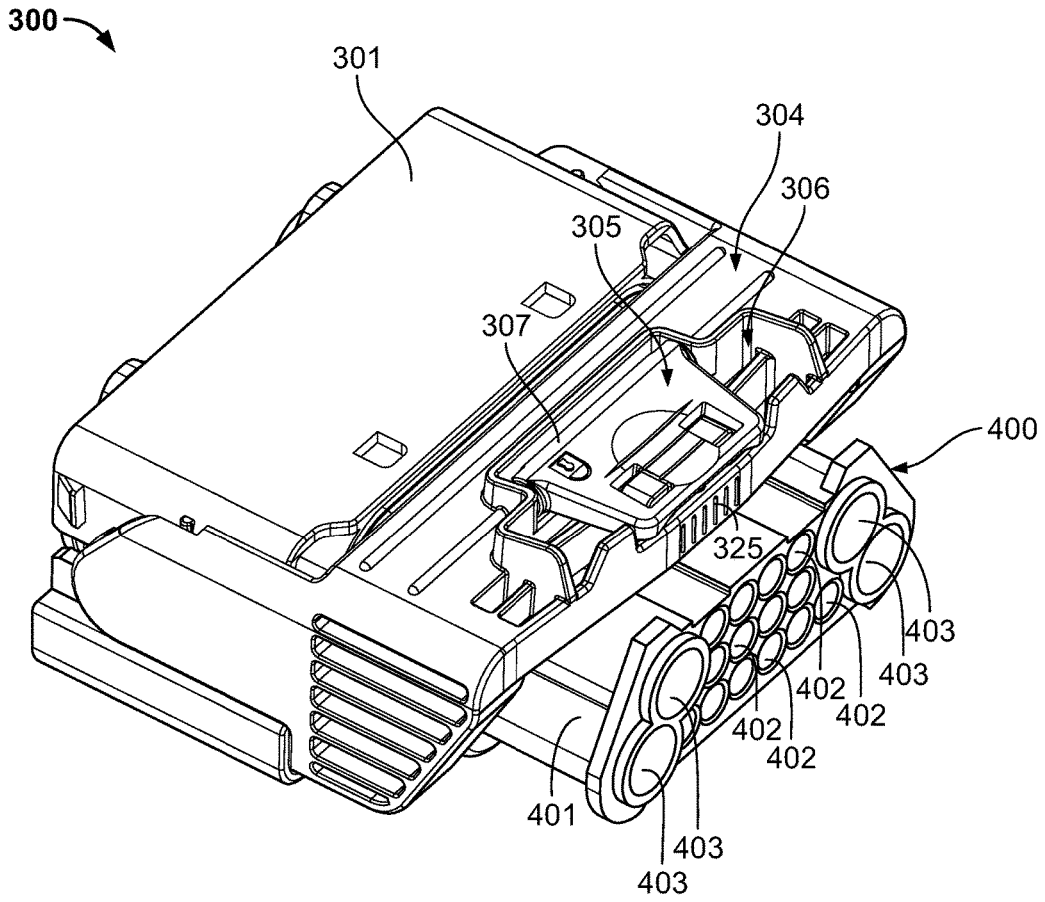
FIG. 5 is a perspective view of an electrical connector according to the invention locked to a mating connector.
Figure 6A:
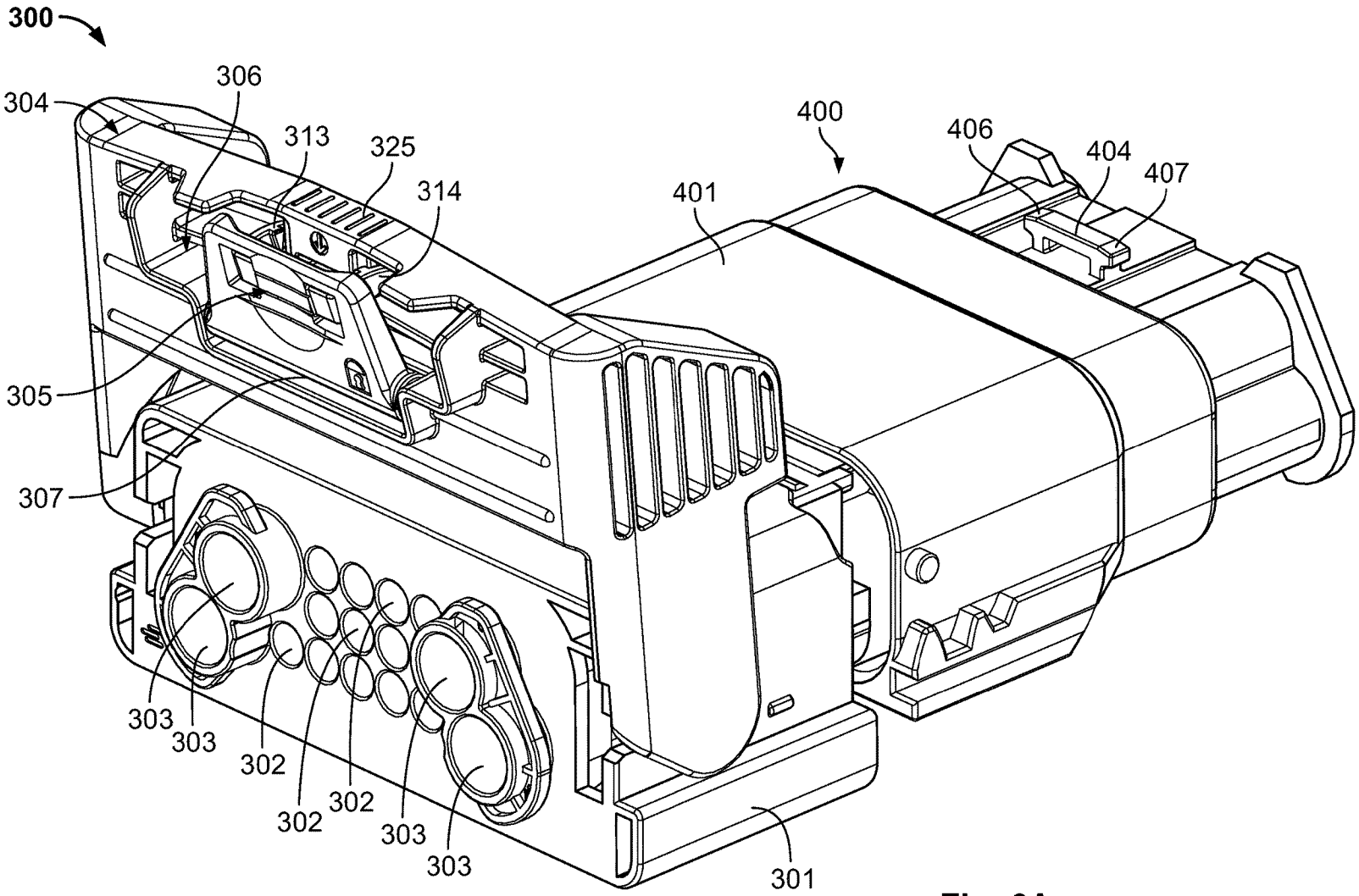
FIG. 6A is a perspective view of the connector of FIG. 5 with a connector position assurance device of the electrical connector in a delivery position and in a first position with respect to the mating connector.
Figure 6B:
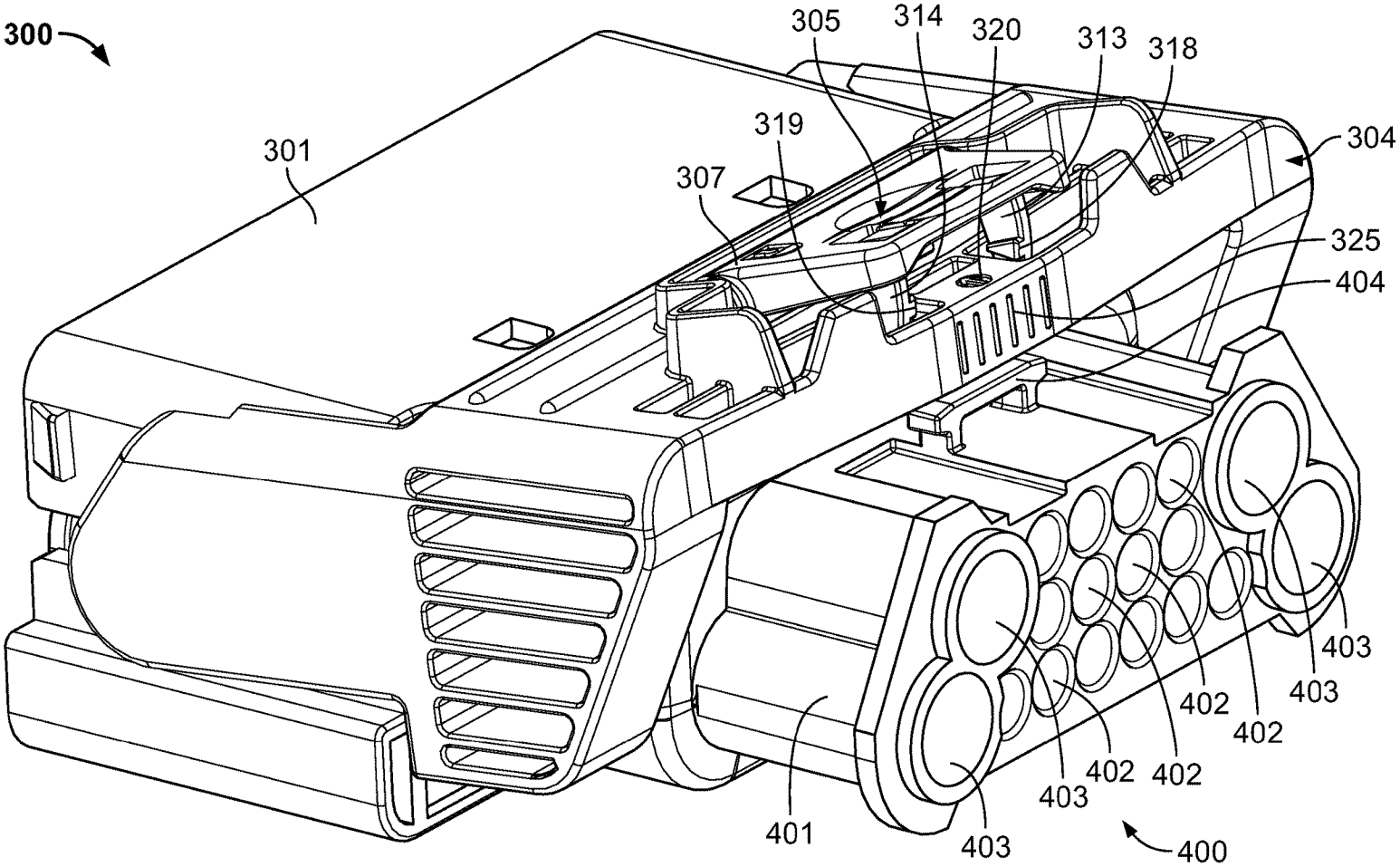
FIG. 6B is a perspective view of the connector of FIG. 5 with a connector position assurance device of the electrical connector in a delivery position and in a second position with respect to the mating connector.

As shown in FIGS. 5, 6A, and 6B, in a manner similar to what has been described for the first embodiment, the electrical connector 300 has a housing 301 which has the same functionalities as the housing 101 of the electrical connector 100, and which can therefore in particular also comprise slots 302, 303 able to house electrical contacts. Similarly, the housing 401 of the mating connector 400 therefore also comprises slots 402, 403 which are similar to those of the housing 201 of the connector 200.

The connector 300, as shown in FIGS. 1, 2A, and 2B, has a locking lever 304 disposed on the housing 301. The locking lever 304 is shown in an open, unlocked position in FIG. 6A, in a partially folded position in FIG. 6B, and in a completely folded and locked position in FIG. 5. Consequently, as in the first embodiment and as shown in FIGS. 6A and 6B, the locking lever 304 providing the main locking means of the connector 300 locks the housing 301 to the housing 401 when it is correctly inserted in the housing 301, hooking onto a locking member 404 protruding from the housing 401 of the mating connector 400.

The connector 300, as shown in FIGS. 5, 6A, and 6B, has a CPA device 305. The CPA device 305 is fitted on the locking lever 304 in a pivotable manner in relation to the lever 304 and therefore also in relation to the housing 301. The CPA device 305 is joined to the locking lever 304 so as to form a pivot connection or hinge in a receiving space 306 of the locking lever 304. Once fitted in the receiving space 306, the CPA device 305 can pivot at least between a raised position shown in FIGS. 6A and 6B, also referred to herein as a delivery position, and a folded position in the receiving space 306 shown in FIG. 5.

The CPA device 305 has a pivoting portion 307 provided with a recess 309 which enables fitting on an element which forms a respective axis 311 in the receiving space 306 of the lever 304.

Figure 7:
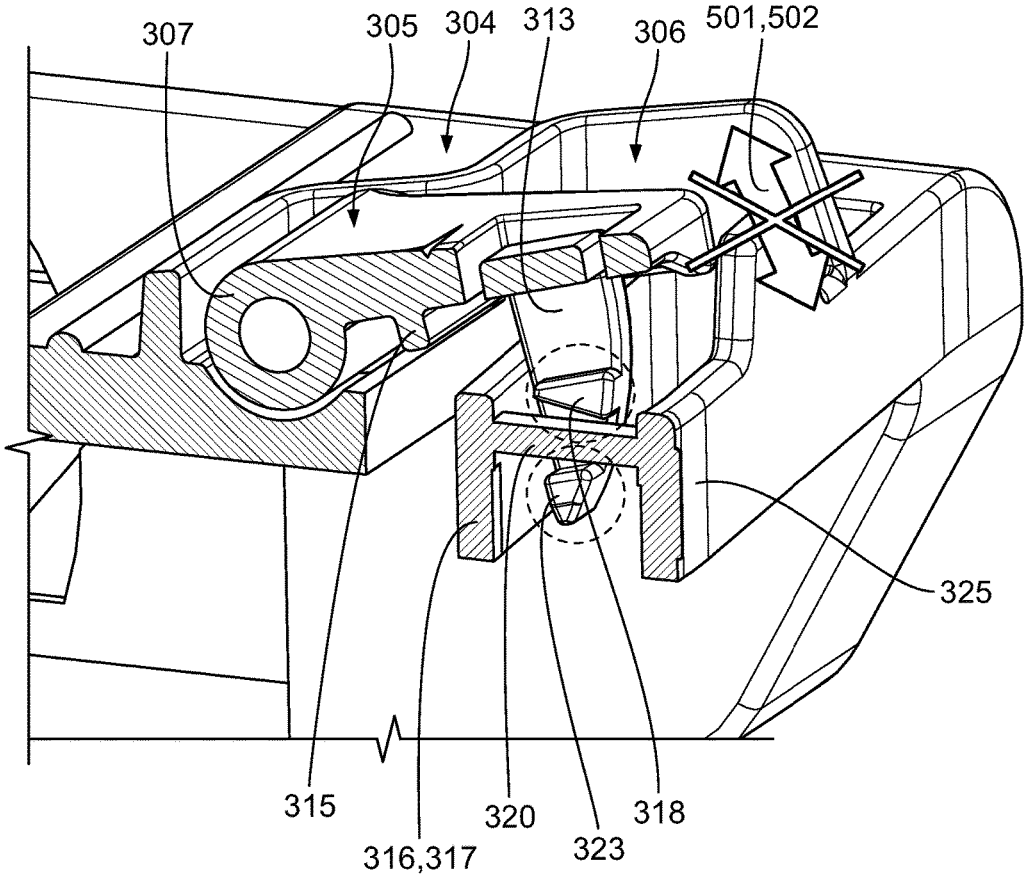
FIG. 7 is a sectional view of the connector position assurance device of FIG. 6A.
Figure 8A:
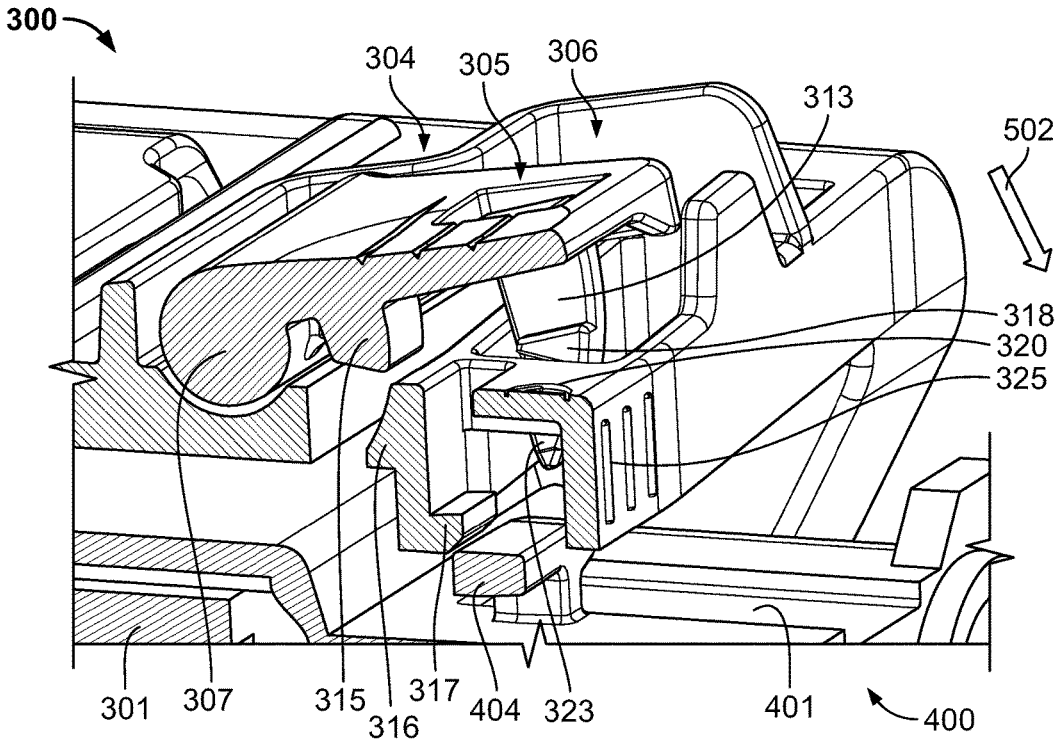
FIG. 8A is a sectional view of a first connection step between the connector of FIG. 5 and the mating connector.
Figure 8B:
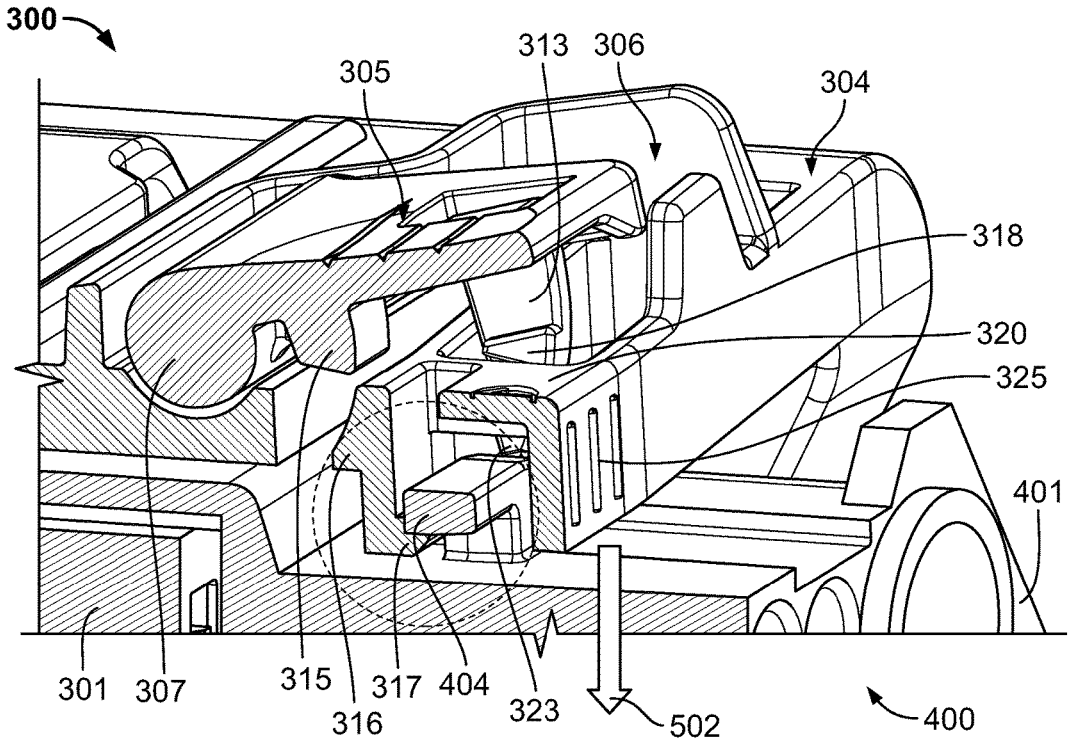
FIG. 8B is a sectional view of a second connection step between the connector of FIG. 5 and the mating connector.
Figure 8C:
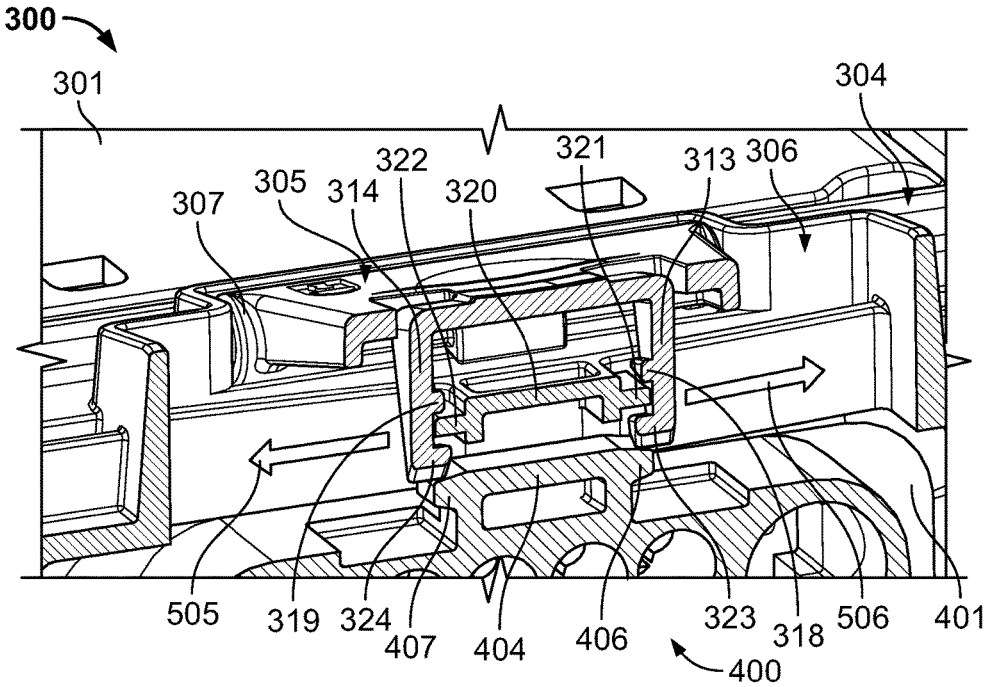
FIG. 8C is a sectional view of the second connection step between the connector of FIG. 5 and the mating connector.
Figure 8D:
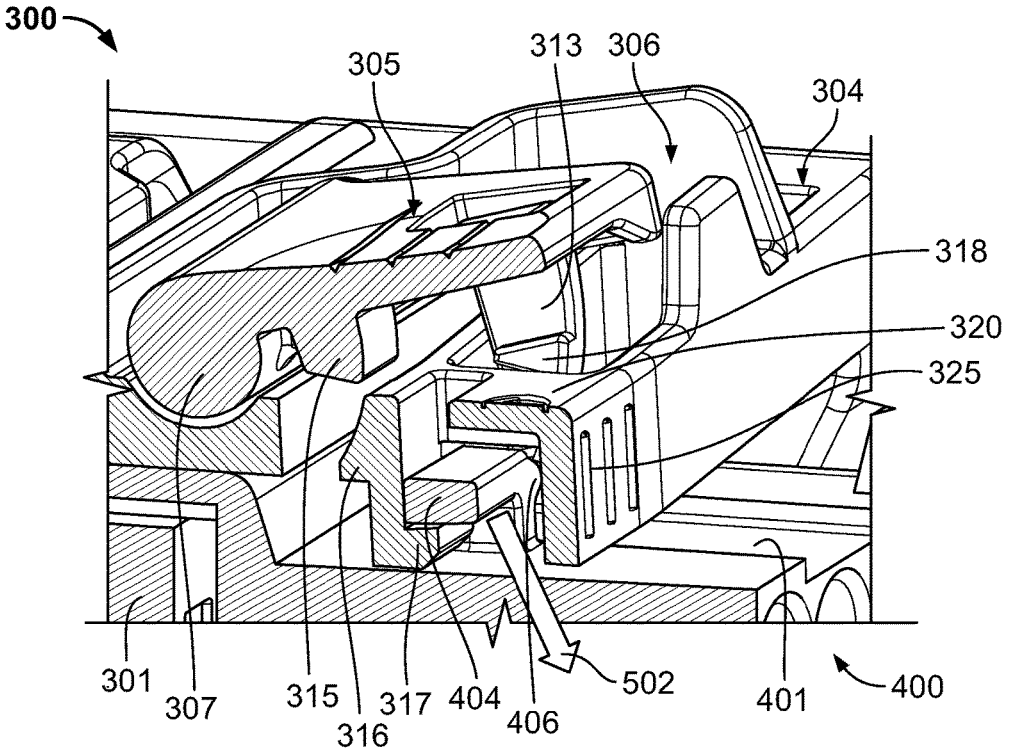
FIG. 8D is a sectional view of a third connection step between the connector of FIG. 5 and the mating connector.
Figure 8E:
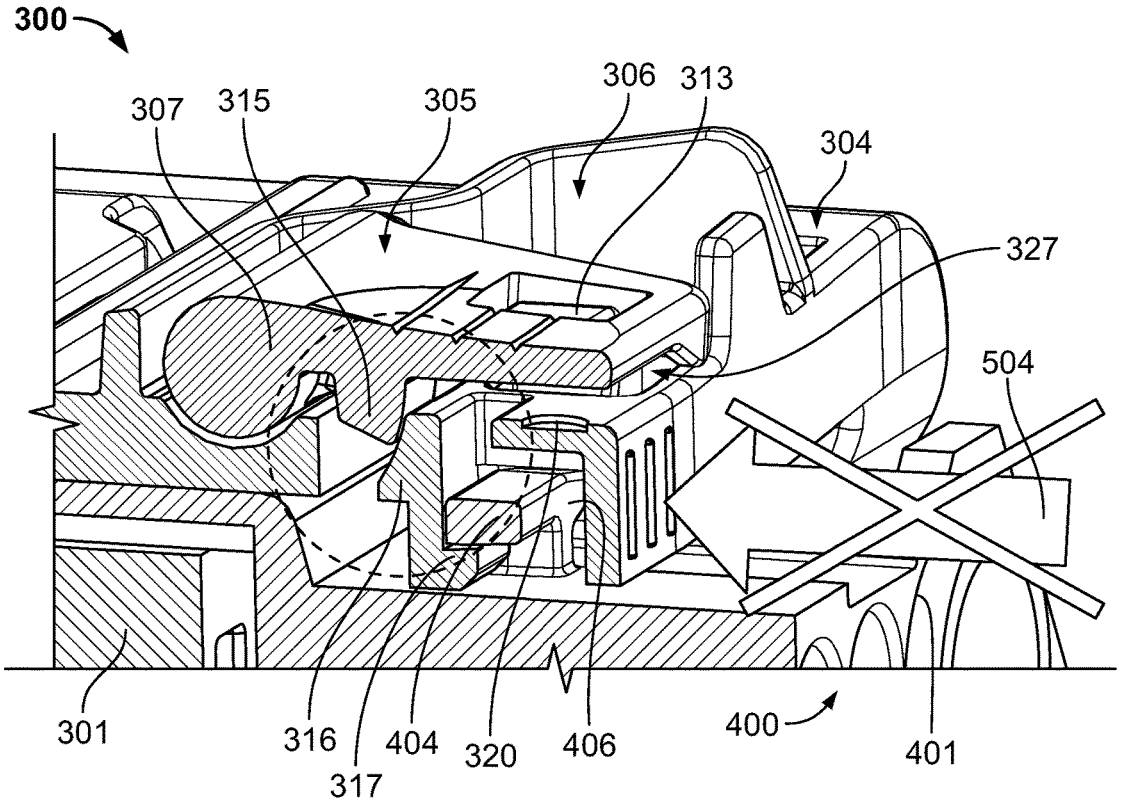
FIG. 8E is a sectional view of a fourth connection step between the connector of FIG. 5 and the mating connector.

In order to carry out secondary locking in the locking position, as shown in FIGS. 5 and 8E-8G, the CPA device 305 has first projections 313, 314 for maintaining a locking between the locking lever 304 and the locking member 404. The first projections 313, 314 are disposed on an end of the CPA device 305 distal from the pivoting portion 307. In the shown embodiment, the first projections 313, 314 are hooks protruding substantially in a folding direction toward the folded position of the CPA device 305, as shown in FIGS. 6A and 6B. The CPA device 305 also has a second projection 315 shown in FIG. 7 protruding in the same direction as the first projections 313, 314. The second projection 315 engages a lug 316 of the lever 304 as shown in FIG. 8E.

The raised position of the CPA device 305, shown in FIGS. 6A and 6B, will now be described in greater detail with reference to FIG. 7. In FIG. 7, the CPA device 305 is in the raised position and the connector 300 is not connected or locked to the mating connector 400.

The pivoting portion 307 prevents inadvertent pivoting or folding down of the CPA device 305 in an activation or locking direction. A first blocking member 318, shown in FIG. 8A, protrudes from the first projection 313, in the region of a median portion of the projection 313. Another first blocking member 319 can also be disposed on the other first projection 314, with the first blocking members 318, 319 facing one another, as shown in FIGS. 6B and 8C. The first blocking members 318, 319, as shown in FIGS. 7 and 8C, stop against a portion of the locking lever 304 and prevent the CPA device 305 from being pivoted toward the locking position. The first blocking members 318, 319 stop against a respective lateral projection 321, 322 of a transverse wall 320 of the locking lever 304. The wall 320 connects an unlocking surface 325 and a locking leg 317 or a lug 316 of the lever 304.

The pivoting portion 307 also prevents inadvertent withdrawal or detachment of the CPA device 305 fitted on the locking lever 304 in an unlocking direction. A second blocking member 323 protruding from an end of the first projection 313 stop against the transverse wall 320 during a withdrawal movement. Another second blocking member 324 can also be disposed on the end of the other first projection 314, with the second blocking members 323, 324 facing one another, as shown in FIGS. 6B and 8C. The second blocking members 323, 324 stop against a respective lateral projection 321, 322 of a transverse wall 320 of the locking lever 304, preventing withdrawal movement of the CPA device 305.

As shown in FIG. 7, the pivoting portion 307 of the CPA device 305 is blocked and held in the raised position as long as a connection and main locking have not been carried out between the mating connectors 300, 400.

The locking between the connector 300 and the mating connector 400 will now be described in greater detail with reference to FIGS. 8A-8G. In FIGS. 8A-8G, the mating housing 401 of the mating connector 400 is correctly inserted in the housing 301 of the connector 300.

After an approach between the mating connectors 300, 400, shown in FIG. 6A, the mating housing 401 is inserted in the housing 301 as far as the end position thereof, as shown in FIG. 6B, wherein electrical contact is established between the conductive elements of the two connectors 300, 400. The locking lever 304 can then begin to be folded down in the locking direction, which may be the same direction as the activation/locking direction of the CPA device 305, and which can therefore also be indicated by the arrow 502.

The step shown in FIG. 8A follows the full insertion of the mating housing 401 into the housing 301 shown in FIG. 6B. The locking lever 304 is folded down in the direction 502 so that a physical contact is initiated between the locking lever 304 and the mating housing 401, in particular between a locking leg 317 of the lever 304 and the locking member 404 of the housing 401. The locking leg 317 has not yet hooked onto the locking member 404 and the CPA device 305 is still blocked in the raised position as shown in FIG. 7.

FIGS. 8B and 8C are two views of a phase wherein rotation of the locking lever 304 has been continued in relation to the step illustrated in FIG. 8A. The locking lever 304 has therefore almost finished its travel and the locking leg 317 therefore is starting to hook onto the locking member 404. The locking lever 304 is sufficiently lowered for the CPA device 305, still in its raised position, also to move into contact with the locking element 404. The second blocking members 323, 324 at the end of each of the first projections 313, 314 can move into contact with chamfered lugs 406, 407 which project laterally outwards from the top of the locking element 404. Continuation of the rotation of the locking lever 304 in the locking direction 502 will therefore push the second blocking members 323, 324 against the chamfered lugs 406, 407 so that the first projections 313, 314 will be able to be redirected in a resilient manner outwards in the respective disengagement directions, indicated by the arrows 505, 506 in FIG. 8C. In other words, continuation of the rotation of the locking lever 304 in the locking direction 502 will enable the CPA device 305 to be able to begin to be released from its raised position.

The travel of the locking lever 304 is finished in FIG. 8D and main locking is complete. The locking leg 317 of the locking lever 304 hooks onto the locking member 404 of the mating connector 400. The resilient redirection by the lugs 406, 407 of the first projections 313, 314 in the disengagement directions 505, 506 is sufficient to release the first blocking members 318, 319. The activation of the CPA device 305 is therefore allowed and the secondary locking will be able to be carried out by closing the CPA device 305. Pressure exerted on the CPA device 305 in the activation/locking direction 502 in order to completely fold it down in the locking position shown in FIGS. 8E-8G causes the first blocking members 318, 319 to move beyond the lateral projections 321, 322 and, on the other hand, the second blocking members 323, 324 to move beyond the lugs 406, 407. The unlocking of the lever 304 can still be carried out by exerting pressure on the unlocking surface 325 in an unlocking direction 504, which would bring about the backward movement of the locking leg 317 in relation to the locking element 404, thereby enabling the locking lever 304 to be raised.

Figure 8F:
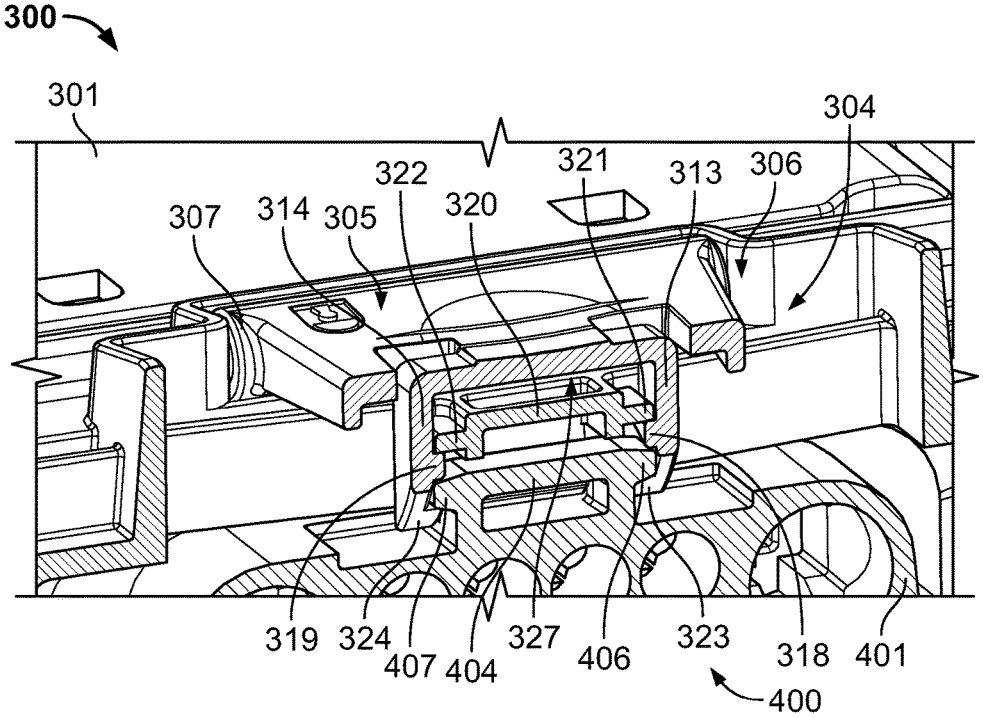
FIG. 8F is a sectional view of the fourth connection step between the connector of FIG. 5 and the mating connector.
Figure 8G:
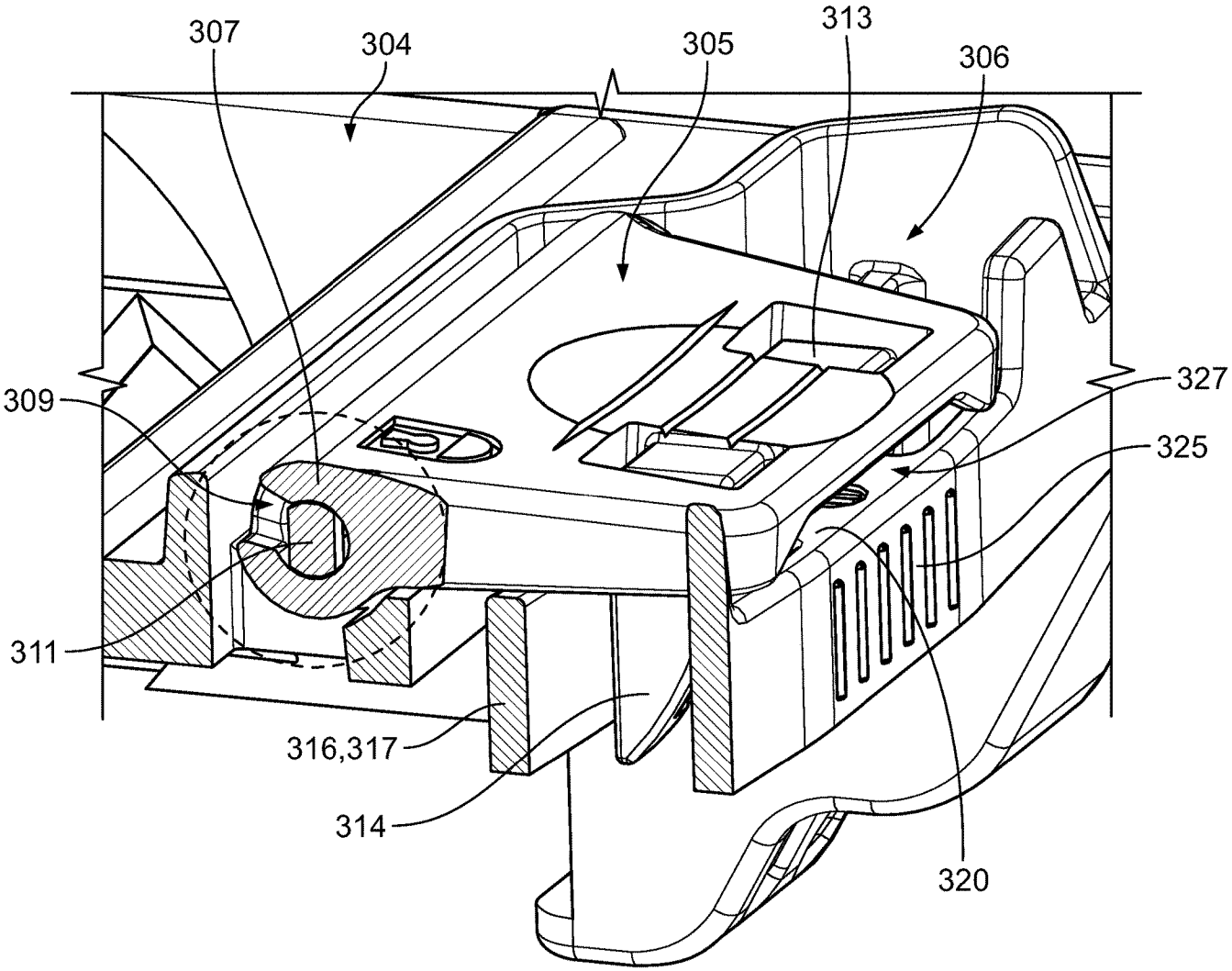
FIG. 8G is a sectional view of the fourth connection step between the connector of FIG. 5 and the mating connector.

In FIGS. 8E and 8F, in relation to the step shown in FIG. 8D, the rotation of the CPA device 305 from its raised position to its locking position has been completed; the CPA device 305 has been completely folded down in the space 306 as far as its locking position. The mating connectors 300, 400 are locked together by main locking or primary locking, which is itself carried out by the secondary locking brought about by the CPA device 305. The first projections 313, 314 of the CPA device 305 hook onto the locking lever 304 of the connector 300 and the locking element 404 of the mating connector 400, as shown in FIGS. 8F and 8G.

The recess 309 of the pivoting portion 307 and the axis 311 prevent detachment of the CPA device 305 from the locking position. As in the first embodiment, in the locking position of the CPA device 305 of the second embodiment, the second projection 315 abuts the lug 316 of the locking lever 304 pressed against the locking leg 317, which therefore prevents disengagement of the locking leg 317, as shown in FIG. 8E. As shown in FIG. 8F, the rotation of the CPA device 305 in locking position positions the first blocking members 318, 319 on the other side of the lateral projections 321, 322 of the lever 304 and, on the other hand, the second blocking members 323, 324 on the other side of the lugs 406, 407. Opening the CPA device 305 in an opening direction 501 is prevented by the first blocking members on the lateral projections 321, 322, on the one hand, and/or by the second blocking members 323, 324 on the lugs 406, 407, on the other hand. From the locking position, therefore, it is no longer possible to unlock the lever 304 simply by pressing on the unlocking surface 325 in the direction indicated by the arrow 504 in FIG. 8E, as backward movement of the locking leg 317 is prevented by the projection 315.

In order to unlock the system, an operator could push the CPA device 305 manually in the unlocking direction 504 so as to disengage the second projection 315 from its stop against the lug 316 and thereby enable the CPA device 305 to be lifted. Alternatively or additionally, a gap or a space 327 is disposed between the unlocking surface 325 and the CPA device 305, as shown in FIGS. 8E-8G, so as to be able to insert a tool moving the first projections 313, 314 in the disengagement directions 505, 506, allowing the CPA device 305 to be raised back into the raised position shown in FIG. 8D, making it possible to release the lever 304 and to thereby unlock the connectors 300, 400.

What is claimed is:

1. An electrical connector, comprising:

a housing having a locking lever with a locking leg, the housing releasably locking to a mating housing of a mating electrical connector by the locking leg hooking onto and engaging a locking member of the mating housing; and a connector position assurance device having a pivoting portion disposed at a first end of the connector position assurance device and pivotally fitted on a pivot axis of the locking lever, the connector position assurance device pivotable in relation to the housing from a delivery position to a locking position and preventing unlocking of the locking lever in the locking position when the housing is connected to the mating housing, the pivoting portion has a first blocking member preventing pivoting of the connector position assurance device out of the delivery position in a locking direction toward the locking position while the locking lever does not lock the housing to the mating housing.

2. The electrical connector of claim 1, wherein the pivoting portion prevents any pivoting of the connector position assurance device out of the delivery position while the locking lever does not lock the housing to the mating housing.

3. The electrical connector of claim 1, wherein the first blocking member prevents pivoting of the connector position assurance device out of the locking position in an unlocking direction toward the delivery position.

4. The electrical connector of claim 1, wherein the pivoting portion has a second blocking member preventing pivoting of the connector position assurance device out of the delivery position in an unlocking direction away from the locking position.

5. The electrical connector of claim 1, wherein the connector position assurance device has a first projection at a second end of the connector position assurance device opposite the first end of the connector position assurance device.

6. The electrical connector of claim 5, wherein the first projection prevents movement of the locking lever when the connector position assurance device is in the locking position.

7. The electrical connector of claim 6, wherein the first projection has a first blocking member preventing pivoting of the connector position assurance device out of the locking position in an unlocking direction toward the delivery position.

8. The electrical connector of claim 7, wherein the first projection has a second blocking member preventing pivoting of the connector position assurance device out of the delivery position in an unlocking direction away from the locking position.

9. The electrical connector of claim 5, wherein the connector position assurance device has a second projection disposed between the first end and the second end of the connector position assurance device.

10. The electrical connector of claim 9, wherein the second projection prevents movement of the locking lever when the connector position assurance device is in the locking position.

11. The electrical connector of claim 10, wherein, when the connector position assurance device is in the delivery position, the first projection and the second projection extend in a direction toward the locking position.

12. The electrical connector of claim 10, wherein the locking lever has a lug engaging the second projection and preventing movement of the locking lever when the connector position assurance device is in the locking position.

13. The electrical connector of claim 1, wherein the locking leg hooks onto the locking member to lock the housing to the mating housing with the connector position assurance device still in the delivery position.

14. The electrical connector of claim 1, wherein the locking member protrudes from the mating housing in a ring, bridge, or inverted horseshoe shape.

15. An electrical connector, comprising:

a housing having a locking lever with a locking leg, the housing releasably locking to a mating housing of a mating electrical connector by the locking leg hooking onto and engaging a locking member of the mating housing; and a connector position assurance device having a pivoting portion disposed at a first end of the connector position assurance device and pivotally fitted on a pivot axis of the locking lever, the connector position assurance device pivotable in relation to the housing from a delivery position to a locking position and preventing unlocking of the locking lever in the locking position when the housing is connected to the mating housing, the connector position assurance device has a first projection at a second end of the connector position assurance device opposite the first end of the connector position assurance device, the first projection prevents movement of the locking lever when the connector position assurance device is in the locking position.

16. The electrical connector of claim 15, wherein the first projection has a first blocking member preventing pivoting of the connector position assurance device out of the locking position in an unlocking direction toward the delivery position.

17. The electrical connector of claim 16, wherein the first projection has a second blocking member preventing pivoting of the connector position assurance device out of the delivery position in an unlocking direction away from the locking position.

18. An electrical connector, comprising:

a housing having a locking lever with a locking leg, the housing releasably locking to a mating housing of a mating electrical connector by the locking leg hooking onto and engaging a locking member of the mating housing; and a connector position assurance device having a pivoting portion disposed at a first end of the connector position assurance device and pivotally fitted on a pivot axis of the locking lever, the connector position assurance device pivotable in relation to the housing from a delivery position to a locking position and preventing unlocking of the locking lever in the locking position when the housing is connected to the mating housing, the connector position assurance device has a first projection at a second end of the connector position assurance device opposite the first end of the connector position assurance device and a second projection disposed between the first end and the second end of the connector position assurance device, the second projection prevents movement of the locking lever when the connector position assurance device is in the locking position.

19. The electrical connector of claim 18, wherein, when the connector position assurance device is in the delivery position, the first projection and the second projection extend in a direction toward the locking position.

20. The electrical connector of claim 18, wherein the locking lever has a lug engaging the second projection and preventing movement of the locking lever when the connector position assurance device is in the locking position.

* * * * *